US011338604B2

(12) United States Patent
Steichen et al.

(10) Patent No.: US 11,338,604 B2
(45) Date of Patent: May 24, 2022

(54) PRINT MEDIA

(71) Applicant: Hewlett-Packard Development Company, L.P., Spring, TX (US)

(72) Inventors: Christine E. Steichen, San Diego, CA (US); Xulong Fu, San Diego, CA (US); Xiaoqi Zhou, San Diego, CA (US); Adam Weisman, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,361

(22) PCT Filed: Apr. 30, 2019

(86) PCT No.: PCT/US2019/029965
§ 371 (c)(1),
(2) Date: Jun. 22, 2021

(87) PCT Pub. No.: WO2020/222812
PCT Pub. Date: Nov. 5, 2020

(65) Prior Publication Data

US 2022/0072889 A1 Mar. 10, 2022

(51) Int. Cl.
*B41M 5/50* (2006.01)
*B41M 5/52* (2006.01)

(52) U.S. Cl.
CPC ..... *B41M 5/5218* (2013.01)

(58) Field of Classification Search
CPC ..... B41M 5/506; B41M 5/508; B41M 5/5218
USPC ..... 428/32.25
See application file for complete search history.

(56) References Cited

U.S. PATENT DOCUMENTS

| | | | |
|---|---|---|---|
| 5,543,909 | A | 8/1996 | Quesnel |
| 5,605,750 | A | 2/1997 | Romano et al. |
| 2002/0158955 | A1 | 10/2002 | Hess et al. |
| 2003/0039808 | A1 | 2/2003 | Ichinose et al. |
| 2004/0109958 | A1 | 6/2004 | Nigam et al. |
| 2006/0115612 | A1 | 6/2006 | Nakata et al. |
| 2008/0062234 | A1 | 3/2008 | Baker |
| 2008/0075847 | A1 | 3/2008 | Kobayashi |
| 2008/0220239 | A1 | 9/2008 | Bi et al. |

(Continued)

FOREIGN PATENT DOCUMENTS

| | | | |
|---|---|---|---|
| EP | 1321300 | A1 | 6/2003 |
| WO | 2008137343 | | 11/2008 |

(Continued)

*Primary Examiner* — Betelhem Shewareged
(74) *Attorney, Agent, or Firm* — Thorpe North & Western LLP

(57) ABSTRACT

A print medium can include a cellulose-based paper substrate with a first surface and a second surface opposite the first surface. The first surface can be treated with an electrically charged treatment layer. An ink-absorbing layer can be positioned on the electrically charged treatment layer. The ink-absorbing layer can include a polymeric binder and surface-activated fumed silica particles. The surface-activated fumed silica particles can include fumed silica particles that are surface-activated with charged multivalent aluminum salt and organosilane reagent. In further detail, an ink-receiving layer can be positioned on the ink-absorbing layer. The ink-receiving layer can include amorphous silica particles, alumina particles, or a combination thereof.

20 Claims, 2 Drawing Sheets

(56) References Cited

U.S. PATENT DOCUMENTS

| | | | | |
|---|---|---|---|---|
| 2008/0268185 | A1 | 10/2008 | Chen et al. | |
| 2011/0003097 | A1 | 1/2011 | Chen et al. | |
| 2011/0039043 | A1 | 2/2011 | Klemann | |
| 2013/0183501 | A1 | 7/2013 | Kasperchik et al. | |
| 2013/0266748 | A1 | 10/2013 | Oguri et al. | |
| 2015/0165807 | A1* | 6/2015 | Zhou ..... | B41M 5/506 428/195.1 |

FOREIGN PATENT DOCUMENTS

| | | | |
|---|---|---|---|
| WO | WO-2013158078 | | 10/2013 |
| WO | WO-2016122487 | A1 | 8/2016 |
| WO | WO-2016130158 | | 8/2016 |
| WO | WO-2016130158 | A | 8/2016 |
| WO | WO-2017078728 | | 5/2017 |
| WO | WO 2017078729 | | 5/2017 |

* cited by examiner

PRINT MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including low printer noise, capability of high-speed recording and multi-color recording. Print media can be prepared that is specific to a particular inkjet printing application, and other print media can be prepared that is more versatile across multiple printing platforms.

DETAILED DESCRIPTION

Figure 1:
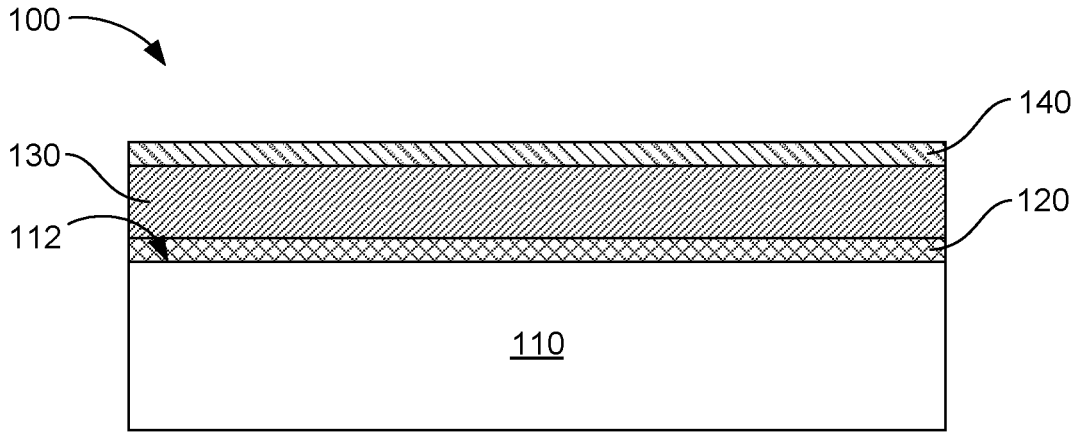
FIG. 1 is a schematic cross-sectional view of an example print medium in accordance with the present disclosure.

The present disclosure is drawn to print media, methods of making print media, and methods of printing using print media, for example. In one example, a print medium includes a cellulose-based paper substrate including a first surface and a second surface opposite the first surface. The first surface in this example is treated with an electrically charged treatment layer. The print medium further includes an ink-absorbing layer on the electrically charged treatment layer. The ink-absorbing layer in this example includes a polymeric binder and surface-activated fumed silica particles, wherein the surface-activated fumed silica particles include fumed silica particles that are surface-activated with charged multivalent aluminum salt and organosilane reagent. The print media also includes an ink-receiving layer on the ink-absorbing layer. The ink-receiving layer in this example includes amorphous silica particles, alumina particles, or a combination thereof. In one specific example, the electrically charged treatment layer includes an electrolyte compound such as calcium chloride, calcium acetate, or a combination thereof. The charged multivalent aluminum salt of the ink-absorbing layer can include aluminum chlorohydrate, for example. Furthermore, the organosilane reagent of the ink-absorbing layer can include amine-containing methoxysilane. In still further detail, the ink-receiving layer can further include both the amorphous silica particles and the alumina particles. The alumina particles can be in the form of boehmite alumina, amorphous alumina, or the amorphous silica particles and the alumina particles can be in the form of amorphous silica-alumina particles. The electrically charged treatment layer can have a dry basis weight from 0.1 gsm to 3 gsm at the first surface, the ink-absorbing layer can have a dry basis weight from 5 gsm to 30 gsm, and the ink-receiving layer has a dry basis weight from 0.1 gsm to 5 gsm in accordance with various examples. The second surface can likewise be treated with a second electrically charged treatment layer, a second ink-absorbing layer is on the second electrically charged treatment layer, and a second ink-receiving layer is on the second ink-absorbing layer. In one example, the second electrically charged treatment layer can be compositionally the same as the first electrically charged treatment layer, the second ink-absorbing layer can be compositionally the same as the first ink-absorbing layer, and the second ink-receiving layer can be compositionally the same as the first ink-receiving layer. The polymeric binder in the ink-absorbing layer can be crosslinked in some examples. Furthermore, the surface-activated fumed silica particles can be present in the ink-absorbing layer at from 40 wt % to about 95 wt % by dry weight.

In another example, a method of making a print medium includes treating a first surface of cellulose-based paper substrate with a treatment solution including an electrolyte compound to form an electrically charged treatment layer. This method also includes coating the electrically charged treatment layer before applying the ink-absorbing coating composition including polymeric binder and surface-activated fumed silica particles to form an ink-absorbing layer. The surface-activated fumed silica particles include fumed silica particles that are surface-activated with charged multivalent aluminum salt and organosilane reagent in this example. In further detail, the method includes coating the ink-absorbing layer with an ink-receiving coating composition that includes colloidal silica particles, alumina particles, or a combination thereof to form an ink-receiving layer that incudes amorphous silica particles, alumina particles, or a combination thereof. In one example, the method can include sequentially drying the treatment solution after application to the first surface to form the electrically charged treatment layer, the ink-absorbing coating composition after application to form the ink-absorbing layer, and the ink-receiving coating composition after application to form the ink-receiving layer. In other examples, the coating layers can be applied in wet-on-wet layering coating processes. In further detail, treating the first surface results in the electrically charged treatment layer can result in a dry basis weight from 0.1 gsm to 3 gsm at the first surface, coating the electrically charged treatment layer results in an ink-absorbing layer can result in a dry basis weight from 5 gsm to 30 gsm, and coating the ink-absorbing layer results in an ink-receiving layer can result in a dry basis weight from 0.1 gsm to 5 gsm.

In another example, a method of printing includes jetting an ink composition to a print medium, wherein the print medium includes a cellulose-based paper substrate including a first surface and a second surface opposite the first surface, where the first surface treated with an electrically charged treatment layer. The print medium also includes an ink-absorbing layer on the electrically charged treatment layer. The ink-absorbing layer in this example includes a polymeric binder and surface-activated fumed silica particles, wherein the surface-activated fumed silica particles include fumed silica particles that are surface-activated with charged multivalent aluminum salt and organosilane reagent. The print medium also includes an ink-receiving layer on the ink-absorbing layer, wherein the ink-receiving layer includes amorphous silica particles, alumina particles, or a combination thereof. In one example, the ink-receiving layer includes the amorphous silica particles and the alumina particles, wherein the alumina particles include boehmite alumina, amorphous alumina, or the amorphous silica particles and the alumina particles are present in the form of amorphous silica-alumina particles.

In these examples, it is noted that when discussing the print medium and the methods herein, any of such discussions can be considered applicable to the other examples, whether or not they are explicitly discussed in the context of that example. Thus, for example, in discussing details about the coated print medium per se, such discussion also refers to the methods described herein, and vice versa.

Referring now to FIG. 1, an example print medium 100 is shown, which incudes a cellulose-based paper substrate 110 with an electrically charged treatment layer 120 on a first surface 112 of the cellulose-based paper substrate. An ink-absorbing layer 130 is positioned on the electrically charged treatment layer. Next, an ink-receiving layer 140 is positioned on the ink-absorbing layer. As described in greater detail hereinafter, the electrically charged treatment layer can include a multi-valent metal salt, for example, that carries a charge. The ink-receiving layer can include polymeric binder that binds together surface-activated fumed silica. The surface-activated fumed silica can be surface-activated by organosilane reagent, such as an aminosilane reagent or some other organosilane reagent. The surface-activated fumed silica can also be surface-activated by a multivalent aluminum salt, such as aluminum chlorohydrate, for example. The ink-receiving layer can include amorphous silica particles that are also held together by a polymeric binder. Other ingredients may also be present in the various layers. The thickness or application density of the respective layers can be based on a dry basis weight (after the layers have dried, e.g., to less than about 6 wt % water content). For example, the dry basis weight of the electrically charged treatment layer can be from 0.1 gsm to 3 gsm, from 0.5 gsm to 3 gsm, or from 0.5 to 2 gsm. The Ink-absorbing layer can have a dry basis weight from 5 gsm to 30 gsm, from 5 gsm to 20 gsm, or from 10 gsm to 20 gsm, for example. The ink-receiving layer can have a dry basis weight from 0.1 gsm to 5 gsm, from 0.1 gsm to 3 gsm, from 0.5 gsm to 3 gsm, or from 0.5 gsm to 2 gsm. As a note, though the print medium example shown in FIG. 1 is uncoated or untreated on the second surface 114, this second surface may be coated with any type of other coating compositions, or some or all of the layers that are shown as applied on the first surface (in any order). In some examples, the second surface, for example, could have the electrically charged treatment layer thereon without the ink-absorbing layer and/or the ink-receiving layer. The second surface could have an adhesive layer and a release liner so that the second surface can be used as an adhesive-backed printing media or some other print medium for application to another surface. In other words, the print medium shown by example in FIG. 1 is intended to show the example print medium with its various layers as shown and described herein, and other layers of any of a number of types could be added to these layers to supplement the function of the print medium shown and described.

Figure 2:
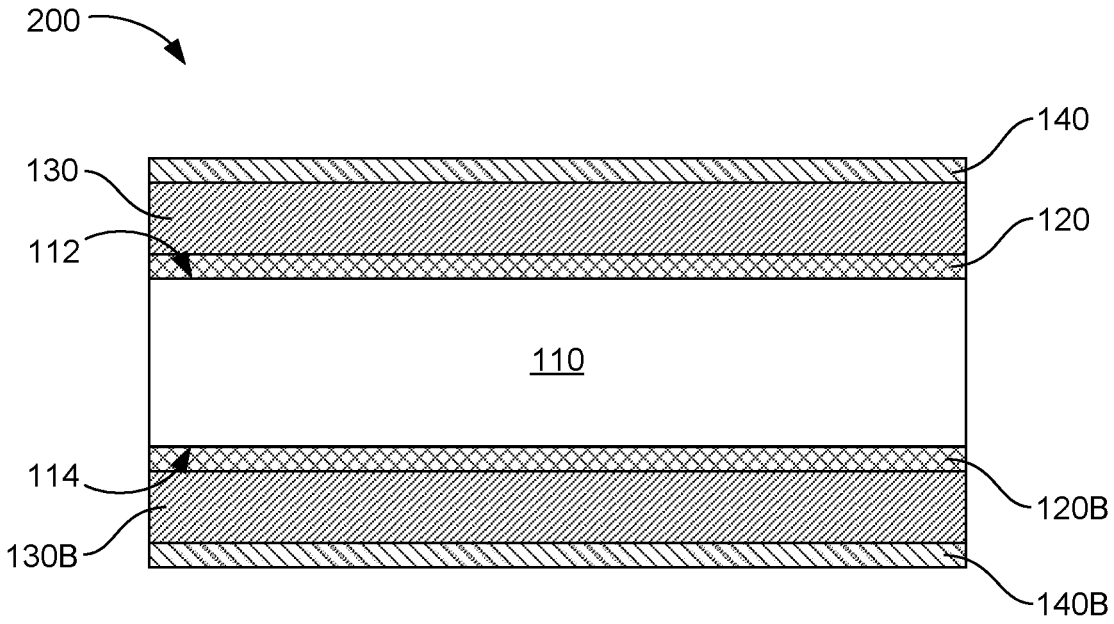
FIG. 2 is a schematic cross-sectional view of an example print medium in accordance with the present disclosure.

Regarding FIG. 2, an alternative print medium 200 is shown with all of the same compositional and structural details described with respect to FIG. 1, but in this example, the various layers are present on both sides of the cellulose-based paper substrate 110. Namely, on a second surface 114, there is a second electrically charged treatment layer 120B, a second ink-absorbing layer 130B, and a second ink-receiving layer 140B. The various "second" layers can also have the same structural features and compositional details as described in FIG. 1 for the respective layers. Additional structural and compositional details for both FIG. 1 and FIG. 2 are presented in further detail hereinafter.

Turning now to the specific components and structures of the print media described herein, there are several materials have been briefly described and will be described in greater detail hereinafter. For example, regarding the "cellulose-based paper substrate," this substrate can generally to be opaque as well as be efficiently absorptive for receiving the electrically charged treatment layer. This paper substrate is defined as not including a synthetic polymer coating thereon, though there may be some polymer dispersed therein. For example, a "photobase" for printing media which has cellulose core extruded with polymeric thin film would not be considered to be "cellulose-based paper substrate," as defined herein, as it includes a polymeric coating thereon. Cellulose is itself a natural polymer that is present in cotton, various hard and soft woods, in the cell walls of green plants, etc. There is also synthetic cellulosic material that can be used. In some examples, the cellulose-based paper substrates can include "wood fiber(s)," which refers to cellulosic fibers and some other paper fibers that may be present. There may be either or both of hardwood fibers and softwood fibers present and/or mixture of both. As used herein, the term "hardwood fiber" or "hardwood pulps" refers to fibrous pulp derived from the woody substance of deciduous trees (angiosperms) such as aspen, birch, oak, beech, maple, and/or eucalyptus. As used herein, the term "softwood fiber" or "softwood pulps" refers to fibrous pulps derived from the woody substance of coniferous trees (gymnosperms), such as varieties of fir, spruce, and pine, as for example loblolly pine, slash pine, Colorado spruce, balsam fir and/or Douglas fir. Thus, some examples of cellulosic materials that can be used include natural cellulosic material, synthetic cellulosic material (such as, for example, cellulose diacetate, cellulose triacetate, cellulose propionate, cellulose butyrate, cellulose acetate butyrate and nitrocellulose). In further detail, in some examples, the substrate is a cellulose-based paper substrate can be prepared from pulp stock containing a fiber ratio (number of hardwood fibers to softwood fibers) from 10:90 to 90:10, from 20:80 to 80:20, from 30:70 to 70:30, from 60:40 to 40:60, from 50:50 to 90:10, or from 60:40 to 80:20, e.g., 70:30. The hardwood fibers can have an average length ranging from 0.3 mm to 3 mm, or from 0.5 mm to 1.5 mm, for example. These relatively short fibers can enhance the formation and smoothness of the cellulose-based paper substrate in some example. Hardwood fibers may be bleached or unbleached hardwood fibers. Rather than virginal hardwood fibers, other fibers with the same length, up to 20% of total hardwood fiber content, can be used as the hardwood fiber in some examples. The other fibers may be recycled fibers, non-deinkable fibers, unbleached fibers, synthetic fibers, mechanical fibers, or combinations thereof. The softwood fibers have an average length ranging from 1 mm to 10 mm, or 2 mm to 7 mm, for example. These relatively long fibers can enhance the mechanical strength of the paper substrate. The fibers may be prepared via any pulping process, such as, for example, chemical pulping processes. Two suitable chemical pulping methods include the kraft process and the sulphite process.

The fibers of the substrate material may be produced from chemical pulp, mechanical pulp, thermal mechanical pulp, chemical mechanical pulp or chemical thermo-mechanical pulp. Examples of wood pulps include, but are not limited to, Kraft pulps and sulfite pulps, each of which may or may not be bleached. The substrate may also include non-cellulose fibers. The pulp used to make the cellulose base may also contain up to 10 wt % (with respect to total solids) of additives. Suitable additives may be selected from a group consisting of a dry strength additive, wet strength additive, a filler, a retention aid, a dye, an optical brightening agent (i.e., optical brightener), a surfactant, a sizing agent, a biocide, a defoamer, or a combination thereof.

The cellulose-based paper substrates can be considered, in some examples, to have an open structure, in that they may include some voids suitable for receiving the electrically charged treatment layer described herein. That stated, in some examples, the cellulose-based paper substrate may include components other than the cellulose-based fibers, such as polymeric binder, e.g., from 0.1 wt % to 10 wt %. If a binder is used, suitable binders that can be used include starch, protein, hydrophilic polymer binder such as polyvinyl alcohol, or the like. Likewise, inorganic fillers, such as calcium carbonate, clay and $TiO_2$, up to a total concentration of 30 wt % of cellulose-based paper can also be present as well. Furthermore, internal sizing agents can also be used at the wet end of a paper manufacturing machine, and include materials such as rosin; rosin precipitated with alum ($Al_2(SO_4)_3$); abietic acid and abietic acid homologues such as neoabietic acid and levopimaric acid; stearic acid and stearic acid derivatives; ammonium zirconium carbonate; silicone and silicone-containing compounds; fluorochemicals of the general structure $CF_3(CF_2)_nR$, wherein R is anionic, cationic or another functional group and n can range from 1 to 1000; starch and starch derivatives; methyl cellulose; carboxymethylcellulose (CMC); polyvinyl alcohol; alginates; waxes; wax emulsions; alkylketene dimmer (AKD); alkenyl ketene dimer emulsion (AnKD); alkyl succinic anhydride (ASA); emulsions of ASA or AKD with cationic starch; ASA incorporating alum; and/or other known internal sizing agents; and mixtures thereof. In some applications, the amount of internal sizing agent can be in the range of about 0.3 Kg/T of raw base paper stock to 10 Kg/T.

Once the open paper substrate is prepared with the cellulosic fibrous material chosen for use, and including any whitener, e.g., titanium dioxide, binder, filler, sizing agents, biocides, etc., elected for use, a multivalent metal salt treatment is then applied to one or both surfaces of the open paper substrate. The multivalent metal salt treatment, as mentioned, includes a multivalent metal salt, such as $CaCl_2$), applied so that 0.1 gsm to 3 gsm (per side treated) of the multivalent metal salt is loaded into the open paper substrate. In one example, the polymeric binder or mixture of polymeric binders such as starch and polyvinyl alcohol, along with processing control agents such as thickener and pH adjustment agent can be formulated with multivalent salt into a treatment composition. The presence of these multivalent metal salts can provide several added advantages, including improvement of image quality, color gamut, and color richness, among other printing improvements.

The fibers of the cellulose-based paper substrate material may be produced from chemical pulp, mechanical pulp, thermal mechanical pulp, chemical mechanical pulp or chemical thermo-mechanical pulp. Other additives that may be present include components such as dry strength additive, wet strength additive, filler, retention aid, dye (or pigment), optical brightening agent, fluorescent whitening agent, surfactant, biocide, defoamer, pH adjusters, sequestering agents, preservatives, and/or the like. For example, paper brightness and/or whiteness of the recording medium can be modified by including optical brightening agent (OBA) or fluorescent whitening agent (FWA). OBAs or FWAs are generally compounds that absorb ultraviolet radiant energy at 300-360 nm of the electromagnetic spectrum and re-emit energy in the visible range mainly in the blue wavelength region (typically 420-470 nm). As a note, these and other types of additives may be included in any of the layers that are applied to the cellulose-based paper substrate.

The basis weight of the cellulose-based paper substrate can be dependent on the nature of the application of the print medium. For example, lighter weight basis weights may be used for magazines, newspapers, books, brochures, e.g., foldable brochures, promotional material, or the like. Heavier weights on the other hand be used for post cards, packaging applications, self-supporting posters, of the like, for example. Thus, the cellulose-based paper substrate can have a basis weight of 40 grams per square meter ($g/m^2$ or gsm) to 300 gsm, from 60 gsm to 250 gsm, or from 100 gsm to 200 gsm, for example.

The cellulose-based paper substrate can provide some fluid absorption. Bristow wheel measurements can be used for a quantitative measure of absorption on the print media of the present disclosure, where a fixed amount of a fluid is applied through a slit to a strip of media that moves at varying speeds. In some examples, the printing substrate of the present disclosure can have an ink absorption rate that is not less than 10 $ml/m^2 \times sec^{1/2}$, as measured by Bristow wheel ink absorption method. (The Bristow wheel is an apparatus also called the Paprican Dynamic Sorption Tester, model LBA92, manufactured by Op Test Equipment Inc.). In still other examples, the cellulose-based paper substrate can have a surface smoothness from 10 Sheffield Smoothness Units (SU) to 150 SU. In other examples, the printing substrate can have a surface smoothness that is from 20 SU to 100 SU, or from 30 SU to 90 SU. Surface smoothness can be measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. In still other examples, the cellulose-based paper substrate can be prepared or selected to have a TAAPI brightness from 80% to 98%, or from 85% to 94%, or from 90% to 92%, for example. The Tappi brightness can be measured using TAPPI Standard T452, "Brightness of pulp, paper, and paperboard (directional reflectance at 457 nm)" by means of Technidyne Brightmeter.

An electrically charged treatment layer is applied to the cellulose-based paper substrate and can provide multiple enhancements to the print medium by providing an electric charging interaction when an ink composition is printed on the print medium. An "electric charging interaction" can refer to positively or negatively charged species that can be coupled together with an opposite charged species, e.g., a species from an ink composition interacting with an oppositely charged species in the electrically charged treatment layer. In one aspect, the electrically charged treatment layer can induce agglomeration (crashing out) of ink colorant from a dispersing ink vehicle to promote a fast drying of printing image. In another aspect, the electrically charged treatment layer can function as an ink fixation layer, as it can act as to immobilize or otherwise limit the mobility of negatively charged colorants from migrating in along a z-axis (defined as perpendicular to the flat surfaces of the print medium) by the electric charging interaction describe above. Furthermore, the electrically charged treatment layer can also provide a fixation to colorants and ameliorate random colorant migration along the x- and y-axes (parallel to the flat surfaces of the print medium), providing for good edge acuity of printed images and eliminating ink bleed. Thus, the electrically charged treatment layer may provide these benefits by inclusion of a charge for a crashing ink dispersion and fixing colorant in ink composition component. This feature may also or alternatively chemically and/or physically bond to ink composition pigments and prevent pigments to further penetrate into the cellulose-based paper substrate, while at the same time, allowing ink solvents to flow into the cellulose-based paper substrate. Thus, in some examples, colorant, e.g., pigment and/or dye, can be held from penetrating the substrate by the electrically charged treatment layer, which may enhance image quality, e.g., optical density, color gamut, edge acuity, etc. Thus, by allowing for solvent penetration into the cellulose-based paper substrate, and by fixing a charged species, such as a colorant, image quality can be enhanced. These properties are provided by way of example, as there may be ink compositions that do not interact with the electrically charged treatment layer in this manner, but because of this feature, the print media of the present disclosure can be considered to be versatile in that they work with many different types of ink compositions.

In examples herein, the electrically charged treatment layer can be applied as a solution leaving charged electrolyte compounds in the layer. An "electrolyte compound" includes a solid compound that may be dissolved in an electrolyte solution that is electrically conductive, but can remain in the electrically charged treatment layer after drying on the cellulose-based paper substrate, for example. The electrolyte compound can be a multivalent metal salt, and when dried, the multivalent metal salt remains on the cellulose-based paper substrate as the electrically charged treatment layer. The multivalent metal salt used can include multivalent metals from Group II metals, Group III metals, transitional metals, or a combination thereof, based on the periodic chart. These multivalent metal salts may further include an anion selected from chloride, iodide, bromide, nitrate, sulfate, sulfite, phosphate, chlorate, acetate, formate, or a combination thereof. Specific examples thereof include calcium chloride, calcium acetate, calcium nitrate, calcium formate, magnesium chloride, barium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, or the like. That being described, calcium chloride ($CaCl_2$)) and calcium acetate have been found to work particularly well and can be a cost-effective choice. These metal salts may be used alone or in combinations of two or more. The metal salt concentration in the surface treatment solution can be any functional concentration, but in some examples, may be included in the coating formulation in excess the critical saturated concentration.

In one example, the multivalent metal salt can be applied as a solution, as mentioned, but there may be other components (dissolved or dispersed) present in the formulation that remain with the treatment layer as dry materials. Examples include polymeric binder, sizing agents, optical brightness agents (OBA), processing or application additives, etc. There can also be organic solvent, such as butyl alcohol, included in addition to the water carrier to enhance coating processing properties when applied. The solution used to apply the electrically charged treatment layer can include, for example, from 0.1 wt % to 30 wt % solids, or from 5 wt % to 20 wt % solids, for example. Upon evaporation of water and solvents, the dry treatment layer left behind, which includes multivalent metal salt, can be present at from 0.1 gsm to 3 gsm. With respect to the other components that may be present in the electrically charged treatment layer, these can be present at relatively small concentrations, e.g., from 0.1 wt % to 10 wt %. Example sizing agents that can be present include, without limitation, starches and starch derivatives; carboxymethylcellulose (CMC); methyl cellulose; alginates; waxes; wax emulsions; alkylketene dimer (AKD); alkyl succinic anhydride (ASA); alkenyl ketene dimer emulsion (AnKD); emulsions of ASA or AKD with cationic starch; ASA incorporating alum; water-soluble polymeric materials, such as polyvinyl alcohol, gelatin, acrylamide polymers, acrylic polymers or copolymers, vinyl acetate latex, polyesters, vinylidene chloride latex, styrene-butadiene, acrylonitrile-butadiene copolymers, styrene acrylic copolymers and copolymers; and various combinations of these agents. With specific reference to starch additives, more specific examples of suitable starches that can be used include corn starch, tapioca starch, wheat starch, rice starch, sago starch and potato starch. These starch species may be unmodified starch, enzyme modified starch, thermal or thermal-chemical modified starch, or chemical modified starch. Examples of chemical modified starch are converted starches such as acid fluidity starches, oxidized starches, or pyrodextrins; derivatized starches such as hydroxyalkylated starches, cyanoethylated starch, cationic starch ethers, anionic starches, starch esters, starch grafts, or hydrophobic starches.

An ink-absorbing layer, as previously mentioned, can then be applied and positioned as a layer on the electrically charged treatment layer. The ink-absorbing layer can include, for example, a polymeric binder and surface-activated fumed silica particles. The surface-activated fumed silica particles can include fumed silica particles that are surface-activated with charged multivalent aluminum salt and organosilane reagent. The multivalent aluminum salt can be, for example, a charged trivalent aluminum salt, such as aluminum chlorohydrate, sometimes referred to as ACH. By way of example, the organosilane reagent of the ink-absorbing layer can include an amine-containing methoxysilane, such as N-(n-Butyl)-3-aminopropyltrimethoxysilane, for example. There are other trivalent aluminum salts and/or other organosilane reagents that can be used, as set forth below, but these are provided above by way of specific example.

In applying the ink-absorbing layer to the electrically charged treatment layer, a coating composition can be the ink-absorbing layer (or ink fusion layer). The coating composition contains from about 40 wt % to about 95 wt % of surface-activated fumed silica particles by total weight of the ink-absorbing layer. In some other examples, the ink-absorbing layer contains from about 65 wt % to about 85 wt % of surface-activated fumed silica particles by total weight of the ink-absorbing layer. Other component(s) can be present, such as polymeric binder, which can be present at from 1 wt % to 60 wt %, from 5 wt % to 40 wt %, or from 10 wt % to 35 wt %, for example. In some examples, a crosslinking agent can be included, such as boric acid for polyvinyl alcohol binder. The crosslinking agent can be included, if present, at from 0.1 wt % to 10 wt %, from 0.5 wt % to 5 wt %, or from 1 wt % to 3 wt %.

The fumed silica particles have been found to provide a good base material for application of the charged multivalent aluminum salt and the organosilane reagent. Fumed silica is sometimes referred to as pyrogenic silica because it is produced in a flame and can have very small droplets of amorphous silica fused into branched, chainlike, three-dimensional secondary particles, which then agglomerate into tertiary particles. Thus, fumed silica has a low bulk density and high surface area. In some examples, the surface area of the surface-activated fumed silica particles is in the range of about 20 to about 800 square meter per gram or in the range of about 100 to about 350 square meter per gram. The surface area can be measured, for example, by adsorption using BET isotherm.

Fumed silica as used herein can be characterized as "nano-sized" pigment particles, as it can have an average particle size that is in the nanometer ($10^{-9}$ meters) range. In some examples, fumed silica particles (that are surface-activated) can have an average particle size in the range of 1 nanometer (nm) to 300 nm, from 2 nm to 150 nm, or from 5 nm to 100 nm, for example. These particles can have any suitable morphology, such as spherical or irregular. The term "average particle size" is used herein to describe diameter or average diameter, which may vary, depending upon the morphology of the individual particle. In an example, the respective particle can have a morphology that is spherical. A spherical particle (e.g., spherical or near-spherical) has a sphericity of >0.84. Thus, any individual particles having a sphericity of <0.84 are considered non-spherical (irregularly shaped). The particle size of the spherical particle and irregular particles may be provided by its average diameter, e.g., the average of multiple dimensions across the particle, or by an effective diameter, which is the diameter of a sphere with the same mass and density as the non-spherical particle.

With reference to the organosilane reagent that is used for surface modification or treatment of the fumed silica, in one example, the organosilane reagent can be used to provide a positively charged moieties to the surface of the fumed silica, or in some instances, to provide another desired function at or near the surface, e.g., ultraviolet absorbers, chelating agents, hindered amine light stabilizers, reducing agents, hydrophobic groups, ionic groups, buffering groups, or functionalities for a subsequent reaction. In accordance with this, the terms "organosilane" or "organosilane reagent" include compositions that comprise a functional moiety (or portion of the reagent that provides desired modified properties to an inorganic particulate surface), which is covalently attached to a silane group. The organosilane reagent can become covalently attached or otherwise attracted to the surface of semi-metal oxide particulates or metal oxide particulates. The functional moiety portion of the organosilane reagent can be directly attached to the silane group, or can be appropriately spaced from the silane group, such as by from 1 to 12 carbon atoms or other known spacer group lengths (including straight chains, branched chains, or alicyclic groups, for example). The silane group of the organosilane reagent can be attached to the fumed silica surface hydroxyl groups but may also attach through any halide or alkoxy groups present on the reagent. In other words, the attachment mechanism may or may not be the hydrocarbyl group mentioned above, but that type of structure is mentioned by example. Alternatively, in some instances, the organosilane reagent can be merely attracted to the surface of the fumed silica. In accordance with examples of the present disclosure, the functional moiety can be any moiety that is desired for a particular application. In one embodiment, the functional moiety can be a primary, tertiary, or quaternary amine.

Organosilanes that may be used include methoxysilanes, halosilanes, ethoxysilanes, alkylhalosilanes, alkylalkoxysilanes, or other known reactive silanes, any of which may be further modified with one or more functional group including amine, epoxy, sulfur-containing groups, e.g., mercapto groups, or heterocyclic aromatic groups. One organosilane for use in accordance with the present invention is an aminosilane, in which one or more of the functional moieties is an amine, which can be primary, secondary, or tertiary. To exemplify aminosilane reagents that can be used to modify such particulates, Formula 1 is provided, as follows:

Formula 1

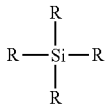

In Formula 1 above, from 0 to 2 of the R groups can be H, —$CH_3$, —$CH_2CH_3$, or —$CH_2CH_2CH_3$; from 1 to 3 of the R groups can be hydroxy, halide, or alkoxy; and from 1 to 3 of the R groups can be an amine (or other functional group if not an aminosilane). Additionally, in Formula 1, R can also include a spacer group that separates the amine functionality from the silane group and/or there can be other moieties that extend beyond the amine (or other) functional moiety. Examples of aminosilane reagents include gamma-aminopropyltriethoxy silane, monoamino silane, diamino silane, triamino silane, etc., if the functional group includes an amine group. As mentioned, other functional groups can be used, instead of amine-containing moieties, such as epoxy-containing moieties, sulfur-containing moieties, heterocyclic moieties, etc. Some specific example aminosilanes that can be used include 3-aminopropyltrimethoxysilane, 3-aminopropyltriethoxysilane, 3-aminoethylaminopropyltrimethoxysilane, 3-aminoethylaminopropyltriethoxysilane, 3-aminoethylaminoethyl aminopropyl trimethoxysilane, 3-aminoethylaminoethylaminopropyltriethoxysilane, 3-aminopropylsilsesquioxane, (n-Butyl)-3-aminopropyltrimethoxysilane, (n-Butyl)-3-aminopropyltriethoxysilane, bis-(3-trimethoxysilylpropyl)amine, N-benzyl-N-aminoethyl-3-aminopropyltrimethoxysilane (e.g., hydrochloride), N-phenyl-3-aminopropyl trimethoxysilane, N-(2-aminoethyl-3-aminopropyltrimethoxysilane, N-(n-Butyl)-3-aminopropyltrimethoxysilane, N-aminoethyl-3-aminopropylmethyldimethoxysilane, 3-(triethoxysilylpropyl)-diethylenetriamine, poly(ethyleneimine) trimethoxysilane, bis(2-hydroethyl)-3-aminopropyltriethoxysilane, 3-aminopropyltriethoxysilane, aminoethylaminopropyl trimethoxysilane, aminoethyl aminoethylaminopropyl trimethoxysilane, or the like. Examples of organosilane groups that can be used that are not aminosilanes (other organosilanes), 3-mercaptopropyl trimethoxysilane, 3-glycidoxypropyltrimethoxysilane, bis(triethoxysilylpropyl)disulfide, 3-ureidopropyltrimethoxysilane, 3-methacryloxypropyltrimethoxysilane, N-(trimethyloxysilyl propyl)isothiouronium chloride, N-(triethoxysilpropyl)-O-polyethylene oxide, 3-(triethoxylsilyl)propylsuccinic anhydride, 3-(2-imidazolin-1-yl)propyltriethoxysilane, poly(ethyleneimine) trimethoxysilane, or the like. Any combination of these or other organosilane reagents can be used to treat the fumed silica surface, for example.

Alternatively, the organosilane can be represented by the general formula $(RO)_{4-X}SiY_X$, where X is from 1 to 3. Thus, from one to three R groups including moieties suitable for covalent attachment to hydroxyl groups at the surface of the fumed silica. In some examples, the R group(s) can independently be a hydrocarbyl group including from 1 to 12 carbon atoms. Thus, the silicon atom or the organosilane can attach one or more of the oxygens at the surface hydroxyl groups of the fumed silica and thus become attached to the surface thereof. The hydrocarbyl group can react with a hydrogen liberated in the attachment reaction, for example. Thus, the RO groups can be hydrolysable in a neutral to acidic environment, allowing for the reaction to occur that generates the covalent linkage, for example. In further detail, from one to three Y groups can independently include an amino group or some other functional group, and in some examples, can include a hydrocarbyl group containing from 1 to 12 carbon atoms.

As previously noted, the organosilane reagent can be used to treat the fumed silica of the ink-absorbing layer. In accordance with examples herein, however, the fumed silica in the ink-receiving layer can be can also be treated with a multivalent aluminum salt, such in a few examples, a trivalent or tetravalent aluminum salt. Example multivalent aluminum salts that can be used include aluminum chlorohydrate (ACH), polyaluminum chloride (PAC), polyaluminum hydroxychloride, or the like. These are a class of soluble charged aluminum salts in which aluminum chloride has been partially reacted with a base. The relative amount of OH compared to the amount of Al can determine the basicity of a particular product. With specific reference to ACH, this compound is often expressed in the form $Al_n(OH)_mCl_{(3n-m)}$, wherein n can be from 1 to 50, and m can be from 1 to 150. Basicity can be defined by the term m/(3n) in that equation. ACH can be prepared by reacting hydrated alumina $AlCl_3$ with aluminum powder in a controlled condition. The exact composition depends upon the amount of aluminum powder used and the reaction conditions. Typically, the reaction can be carried out to give a product with a basicity of 40% to 83%. ACH can be supplied as a solution but can also be supplied as a solid. There are also other ways of referring to ACH, which can exhibit many different molecular sizes and configurations in a single mixture. An exemplary stable ionic species in ACH can have the formula $[Al_{12}(OH)_{24}AlO_4(H_2O)_{12}]^{7+}$. Other examples include $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

Various names used to describe ACH and/or other charged multivalent aluminum compounds components include aluminum chloride hydroxide (8Cl); A 296; ACH 325; ACH 331; ACH 7-321; Aloxicoll; Aloxicoll LR; aluminium hydroxychloride; Aluminol ACH; aluminum chlorhydrate; aluminum chlorohydroxide; aluminum chloride hydroxide oxide, basic; aluminum chloride oxide; aluminum chlorohydrate; aluminum chlorohydrol; aluminum chlorohydroxide; aluminum hydroxide chloride; aluminum hydroxychloride; aluminum oxychloride; Aquarhone; Aquarhone 18; Astringen; Astringen 10; Banoltan white; basic aluminum chloride; basic aluminum chloride, hydrate; Berukotan AC-P; Cartafix LA; Cawood 5025; Chlorhydrol; Chlorhydrol Micro-Dry; Chlorhydrol Micro-Dry SUF; E 200; E 200 (coagulant); Ekoflock 90; Ekoflock 91; GenPac 4370; Gilufloc 83; Hessidrex WT; HPB 5025; Hydral; Hydrofugal; Hyper Ion 1026; Hyperdrol; Kempac 10; Kempac 20; Kemwater PAX 14; Locron; Locron P; Locron S; Nalco 8676; OCAL; Oulupac 180; PAC; PAC (salt); PAC 100W; PAC 250A; PAC 250AD; PAC 300M; PAC 70; Paho 2S; PALC; PAX; PAX 11S; PAX 16; PAX 18; PAX 19; PAX 60p; PAX-XL 1; PAX-XL 19; PAX-XL 60S; PAX-XL 61S; PAX-XL 69; PAX-XL 9; Phacsize; Phosphonorm; (14) poly (aluminum hydroxy) chloride; polyaluminum chloride; Prodefloc AC 190; Prodefloc AL; Prodefloc SAB 18; Prodefloc SAB 18/5; Prodefloc SAB 19; Purachem WT; Reach 101; Reach 301; Reach 501; Sulzfloc JG; Sulzfloc JG 15; Sulzfloc JG 19; Sulzfloc JG 30; TAI-PAC; Taipac; Takibine; Takibine 3000; Tanwhite; TR 50; TR 50 (inorganic compound); UPAX 20; Vikram PAC-AC 100S; WAC; WAC 2; Westchlor 200; Wickenol 303; Wickenol CPS 325 Aluminum chlorohydrate $Al_2ClH_5O_5$ or $Al_2(OH)_5Cl.2H_2O$ or $[Al(OH)_2Cl]_x$ or $Al_6(OH)_{15}Cl_3$; $Al_2(OH)_5Cl]_x$; aluminum chlorohydroxide; aluminum hydroxychloride; aluminum chloride, basic; aluminum chloride hydroxide; $[Al_2(OH)_nCl_{6-n}]_m$; $[Al(OH)_3]_nAlCl_3$; or $Al_n(OH)_mCl_{(3n-m)}$ (where generally, 0<m<3n); for example. By contacting the fumed silica particle with an aluminum compound as described above, the aluminum compound can become associated with a surface of the fumed silica particles. This can be either by covalent association or through an electrostatic interaction to form cationic charged fumed silica, which can be measured by a Zeta potential instrument for verification, for example.

Thus, the fumed silica of the ink-absorbing layer can be surface treated with both a multivalent aluminum salt as well as an organosilane reagent. As noted, there can also be polymeric binder present in the ink-absorbing layer. The "polymeric binder" can be any polymer substance that can be used in an amount that binds the surface-activated fumed silica particles together in a cohesive ink-absorbing layer, while still retaining functionality of the surface-activated fumed silica, e.g. allowing liquid from an ink to fill voids between the fumed silica particles. The polymeric binder material that can be used may include polyvinyl alcohol, copolymer of polyvinylalcohol, derivatives of polyvinylalcohol, polyethylene oxide, gelatin, PVP, copolymer of polyvinylpyrrolidone, polyurethanes, latex emulsion polymers, e.g., acrylics, methacrylics, styrenes acrylics or methacrylics, etc., or the like.

Other additives can also be present, such as crosslinking agents for the polymeric binders. For example, for polyvinyl alcohol, the crosslinking agent can be boric acid, formaldehyde, glutalehyde, glycoxal, Curesan 199 (BASF), Curesan 200 (BASF), or the like, for polyvinyl alcohol, or plasticizers for the polymeric binder. Examples of the crosslinkers for polyvinylalcohol are boric acid, formaldehyde, glutaldehyde, glycoxal, Curesan 199 (BASF), Curesan 200 (BASF), or the like. Examples of the plasticizers for polyvinylalcohol may include glycerol, ethylene glycol, diethyleneglycol, triethylene glycol, morpholine, methylpyrrolidone, polyethyleneglycol, or the like.

An ink-receiving layer can be applied on top of the ink-absorbing layer. The ink-receiving layer in examples herein is the layer of the print medium that first contacts the ink composition when printed thereon. Thus, it receives the ink composition. This thin layer can provide characteristics of being porous and scratch-resistant, along with having a glossy surface. In the case of pigmented inks, this layer can provide a surface where some of the pigment can penetrate through the layer and land on ink-absorbing layer, thus contributing to good durability to the printed image in the form of scratch resistance, rub resistance, and/or water resistance. This layer also contributes to an acceptable level of gloss, color gamut and black optical density, etc. With dye-based inks, this ink-receiving layer is also beneficial because it can allow the dye colorant to penetrate through the layer and then act as an "overprotection layer" to avoid mechanical damage in the printed image, while contributing to achieving a similar printing quality performance as it does in the case of pigmented ink. Furthermore, with anionic dyes, the organosilane reagent may be cationic and can interact with the dye in some examples. The ink-receiving layer can be applied relatively thinly at a dry basis weight from 0.1 gsm to 5 gsm, from 0.1 gsm to 3 gsm, from 0.5 gsm to 3 gsm, or from 0.5 gsm to 2 gsm.

The ink-receiving layer can include amorphous silica particles, alumina particles, or a combination of both. When the ink-receiving layer is dried, the amorphous silica particles and/or alumina particles can pack into a liquid permeable porous layer. Amorphous silica is a suspension of fine amorphous, nonporous, and typically spherical silica particles in a liquid phase. Usually they are suspended in an aqueous phase that is stabilized electrostatically. Colloidal silicas exhibit particle densities in the range of 2.0 g/cm$^3$ to 2.4 g/cm$^3$, or from 2.1 g/cm$^3$ to 2.3 g/cm$^3$. The amorphous silica particles can also be characterized as "nano-sized" pigment particles, as they can have an average particle size that is in the nanometer ($10^{-9}$ meters) range. In some examples, amorphous silica particles can have an average particle size (as defined previously with respect to the fumed silica particles) in a range from 10 nm to 500 nm, from 15 nm to 350 nm, or from 20 nm to 200 nm, for example. These particles can have any suitable morphology, such as spherical or irregular, but typically can be spherical, again as previously defined.

In other examples, the ink-receiving layer can include alumina particles, such as amorphous alumina particles. There can also be a combination amorphous silica particles and alumina particles, a combination of amorphous silica particles and amorphous alumina particles, amorphous silica-alumina particles, or the like. Amorphous silica-alumina particles may include amorphous silica particles composited with alumina and can be prepared by precipitation of hydrous alumina onto amorphous silica hydrogel, by reacting silica sol with alumina sol, or by coprecipitation of a silicate salt with an aluminum salt in solution. Any of these various types of particles or combinations of particles can also be characterized as "nano-sized" pigment particles, as they can have an average particle size that is in the nanometer ($10^{-9}$ meters) range. The amorphous silica particles in these combinations can defined as previously described. The alumina particles, amorphous alumina particles, or composited amorphous silica-alumina particles, can have an average particle size in the range of 20 nm to 500 nm, from 20 nm to 400 nm, from 20 nm to 300 nm, from 20 nm to 200 nm, or from 50 nm to 150 nm, for example. These particles can have any suitable morphology, such as spherical or irregular, but often can be spherical, again as previously defined. In some examples, there can be amorphous silica particles and alumina particle (amorphous or otherwise) co-dispersed together in the ink-receiving layer. If both are present, the weight ratio of amorphous silica particles to alumina particles can be from 20:1 to 1:3, from 15:1 to 1:3, from 10:1 to 1:3, from 10:1 to 1:2, or from 10:1 to 1:1, for example.

In addition to the amorphous silica particles and/or alumina particles in the ink-receiving layer, there can also be, in some examples, polymeric binder can be present to bind the amorphous particles together, leaving space to allow fluid from ink compositions to pass therethrough to the ink-absorbing layer. Again, the polymeric binder can be any polymer substance that can be used in an amount that binds the amorphous silica particles together into a porous ink-receiving layer. The polymeric binder material that can be used may include polyvinyl alcohol, copolymer of polyvinylalcohol, derivatives of polyvinylalcohol, polyethylene oxide, gelatin, PVP, copolymer of polyvinylpyrrolidone, polyurethanes, latex emulsion polymers, e.g., acrylics, methacrylics, styrenes acrylics or methacrylics, etc., or the like. The ink-receiving layer may also contain residual surfactants or wetting agents (to wet an evenly coat the substrate upon fluid application), dispersing agents (to retain a stable colloid during formulation storage), viscosity modification agents (to achieve acceptable viscosity for manufacturing equipment of choice), and/or salts (those which help to retain a stable colloid for formulation storage), etc.

Figure 3:
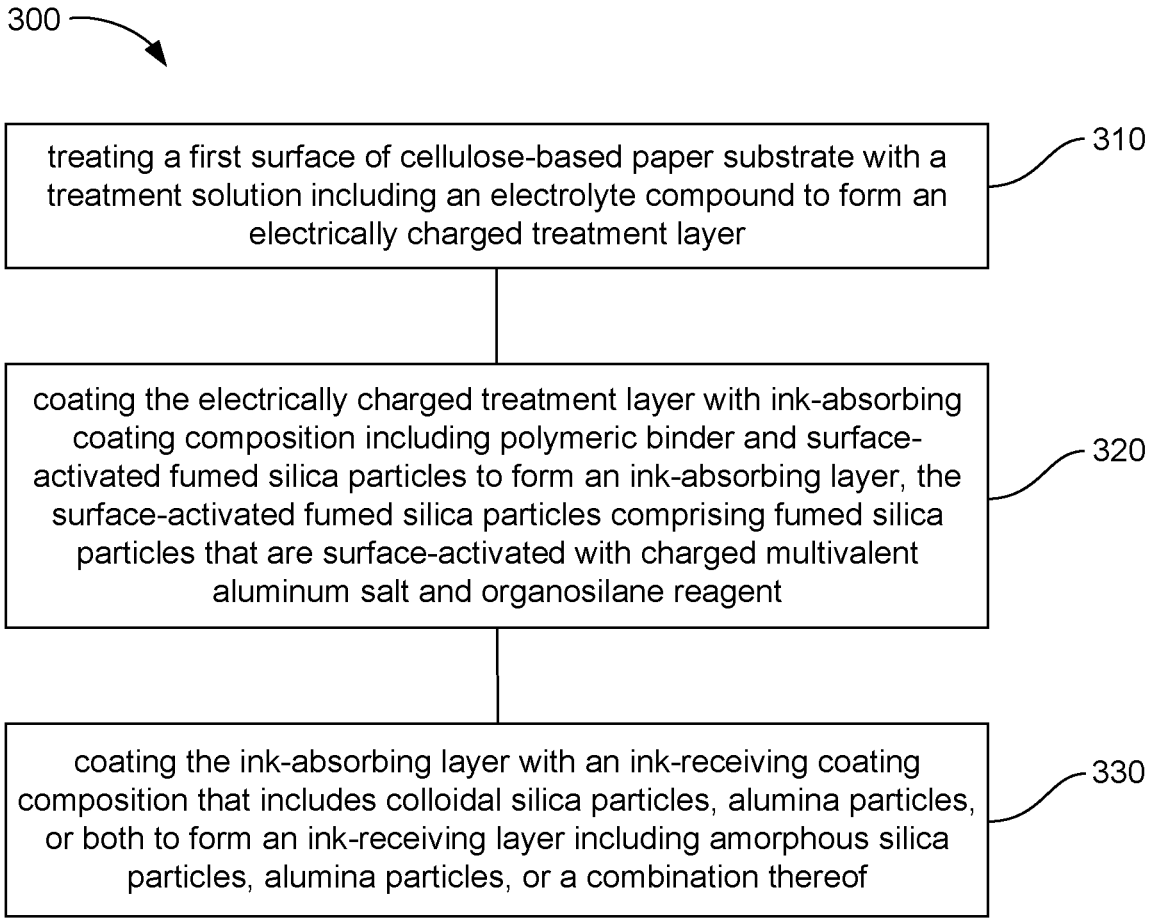
FIG. 3 is a flow diagram representing an example method of preparing a print medium in accordance with the present disclosure.

In another example, as shown in FIG. 3, a method of making a print medium is shown generally at 300 and can include treating 310 a first surface of cellulose-based paper substrate with a treatment solution including an electrolyte compound to form an electrically charged treatment layer. This method also includes coating 320 the electrically charged treatment layer with ink-absorbing coating composition including polymeric binder and surface-activated fumed silica particles to form an ink-absorbing layer. The surface-activated fumed silica particles include fumed silica particles that are surface-activated with charged multivalent aluminum salt and organosilane reagent in this example. In further detail, the method includes coating 330 the ink-absorbing layer with an ink-receiving coating composition that includes amorphous silica particles, alumina particles, or a combination thereof, to form an ink-receiving layer. In one example, the method can include sequentially drying the treatment solution after application to the first surface to form the electrically charged treatment layer, the ink-absorbing coating composition after application to form the ink-absorbing layer, and the ink-receiving coating composition after application to form the ink-receiving layer. In further detail, treating the first surface results in the electrically charged treatment layer can result in a dry basis weight from 0.1 gsm to 3 gsm at the first surface, coating the electrically charged treatment layer results in an ink-absorbing layer can result in a dry basis weight from 5 gsm to 30 gsm, and coating the ink-absorbing layer results in an ink-receiving layer can result in a dry basis weight from 0.1 gsm to 5 gsm.

Figure 4:
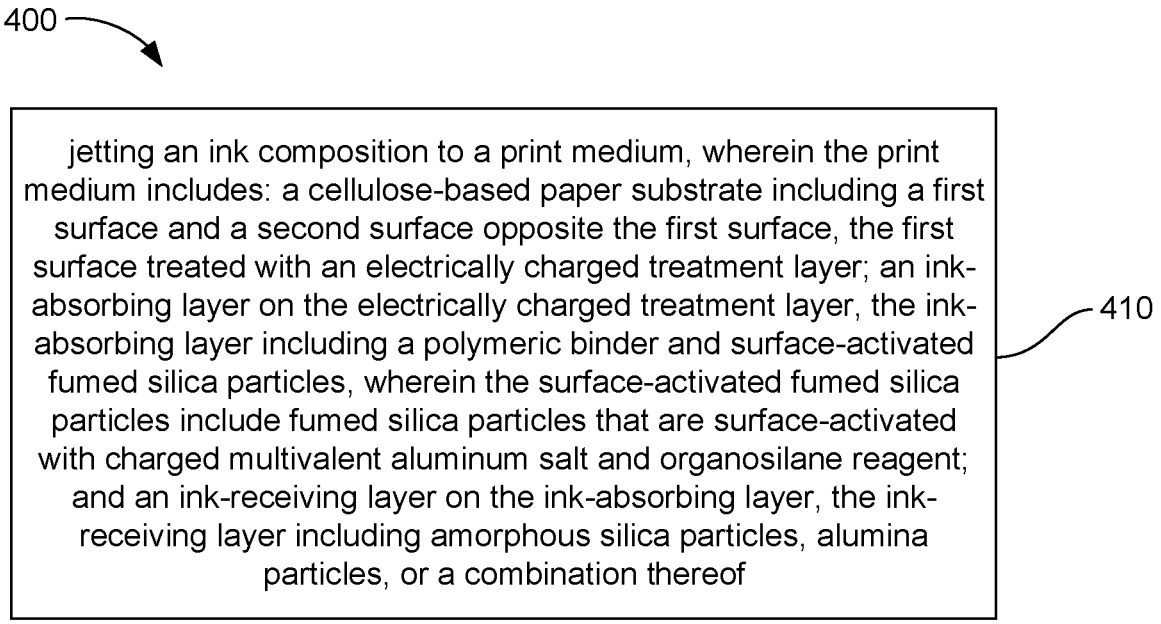
FIG. 4 is a flow diagram representing an example method of printing in accordance with the present disclosure.

The print media described herein can provide the ability to generate high quality and durable printed images with a variety of inks and printers, thus exhibiting good versatility. Images with good image quality (such as vivid color gamut, good black optical density, low ink bleed, good coalescence, good durability performance, etc.) can be achieve, and in some examples can dry quickly enough to perform well with high-speed printing. Thus, the present disclosure also relates to a method 400 of printing which can include jetting 410 an ink composition to a print medium, as illustrated in FIG. 4. The print medium can include a cellulose-based paper substrate including a first surface and a second surface opposite the first surface. The first surface can be treated with an electrically charged treatment layer. The print medium can also include an ink-absorbing layer on the electrically charged treatment layer. The ink-absorbing layer in this example includes a polymeric binder and surface-activated fumed silica particles, wherein the surface-activated fumed silica particles include fumed silica particles that are surface-activated with charged multivalent aluminum salt and organosilane reagent. The print medium in this example also includes an ink-receiving layer on the ink-absorbing layer, wherein the ink-receiving layer includes amorphous silica particles, alumina particles, or a combination thereof. In one example, the ink-receiving layer can include both amorphous silica particles and alumina particles.

It is noted that, as used in this specification and the appended claims, the singular forms "a," "an," and "the" include plural referents unless the content clearly dictates otherwise.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc.

All percent are by weight (wt %) unless otherwise indicated.

It is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof.

EXAMPLES

The following illustrates several examples of the present disclosure. However, it is to be understood that the following are only illustrative of the application of the principles of the present disclosure. Numerous modifications and alternative compositions, methods, systems, etc., may be devised without departing from the scope of the present disclosure. The appended claims are intended to cover such modifications and arrangements.

Example 1—Preparation of Treatment Compositions for Applying Electrically Charged Treatment Layer on Cellulose-Based Paper Substrate Multiple electrically charged treatment layer coating compositions are prepared in accordance with Table 1 below that can be used to treat cellulose-based paper substrates in accordance with the present disclosure, as follows:

TABLE 1

| | Treatment Layer (T) Coating Composition (Wet Weight) | | | | | | |
|---|---|---|---|---|---|---|---|
| | T1 (wt %) | T2 (wt %) | T3 (wt %) | T4 (wt %) | T5 (wt %) | T6 (wt %) | T7 (wt %) |
| Calcium Chloride | 1 | — | 1 | 1 | — | 3 | — |
| Calcium Acetate | — | 5 | — | — | 5 | — | 2 |
| Hydroxyethyl Starch Ether Polymeric Binder (Penford ® 288; Penford Products Co.) | — | — | 10 | — | 5 | 7 | — |
| Acrylic polymeric Binder (Econext ®110; Dow) | — | — | — | 10 | — | — | 10 |
| Water | 99 | 95 | 89 | 89 | 90 | 90 | 88 |

Notably, the weight percentages are provided above for the electrically charged treatment layers in the form of the coating compositions or formulations, before the water is evaporated or dried therefrom to leave the electrically charged treatment layer. After drying, the remaining components provide a dry weight percentage of solids coated on, and to some degree, soaked into a surface of the cellulose-based paper substrate. For example, T1 and T2 would both have a theoretical dry wt % of 100 wt % calcium chloride and calcium acetate, respectively. T3 and T4 would have a dry wt % of calcium chloride of about 9 wt %, with about 91 wt % hydroxyethyl starch, and so forth. As a note, these theoretical dry weight percentages would be present if all of the water were removed prior to applying the ink-absorbing layer. In practicality, not all water or other liquids may evaporate or dry off during processing, and thus, the actual weight percentages of the dry components within the electrically charged treatment layer may be slightly less than the theoretical remaining weight percentage of solids.

Example 2—Preparation of Ink-Absorbing Layer Coating Compositions for Applying to Electrically Charged Treatment Layer Multiple ink-absorbing layer coating compositions are prepared in accordance with Table 2 below that can be used to coat an electrically charged treatment layer in accordance with the present disclosure, as follows:

TABLE 2

| Ink-absorbing Layer (Dry Weight) | A1 (wt %) | A2 (wt %) |
|---|---|---|
| Fumed Silica (Cab-O-Sil; Cabot) | 70.64 | 77.18 |
| Aluminum Chlorohydrate (ACH; Clariant) | 2.12 | — |
| N-(n-Butyl)-3-aminopropyltrimethoxysilane (Organosilane; Aldrich) | 6.36 | — |
| Acetic Acid (pH Control; Aldrich) | 0.88 | 0.96 |
| Polyvinyl Alcohol (Polymeric Binder; Aldrich) | 16.80 | 18.36 |
| Boric Acid (PVA Crosslinker; Aldrich) | 2.00 | 2.19 |
| Glycerol (Humectant; Aldrich) | 0.80 | 0.87 |
| Surfactant (Silicone Surfactant; Momentive) | 0.40 | 0.44 |
| Total | 100 | 100 |

Example 3—Preparation of Ink-Receiving Layer Coating Compositions for Applying to Ink-Absorbing Layer Multiple ink-receiving layer coating compositions are prepared in accordance with Table 3 below that can be used to coat an ink-absorbing layer in accordance with the present disclosure, as follows:

TABLE 3

| Ink-receiving Layer (Dry Weight) | R1 (wt %) | R2 (wt %) | R3 (wt %) |
|---|---|---|---|
| Acetic Acid (pH Control; Aldrich) | — | 1.10 | 1.45 |
| Polyvinyl Alcohol (Polymeric Binder; Aldrich) | — | 10.15 | 11.45 |
| Hydroxyethyl Cellulose (Thickener; Sigma Aldrich) | 2.91 | — | — |
| Surfactant (Ethoxylated Nonionic Fluorosurfactant; DuPont) | 0.33 | 0.59 | — |
| Surfactant (Silicone Surfactant; Momentive) | 0.23 | 0.18 | — |
| Surfactant (Alcohol Alkoxylated Surfactant; BYK) | — | — | 0.44 |
| Potassium Chloride (Ion exchange stability agent; Aldrich) | — | 0.04 | 0.04 |
| Colloidal Silica (Amorphous Silica as Dried; Clariant) | 96.53 | 22.28 | — |
| Alumina (Boehmite; Sasol) | — | 65.66 | 86.61 |
| Total | 100 | 100 | 100 |

Example 4—Preparation of Example Print Media Samples and Comparative Print Media Samples Various print media samples were prepared in accordance with the various layers described in Examples 1-3. More specifically, Print Media Samples A-H were prepared in accordance with Tables 4 below. The cellulose-based paper substrate had a basis weight of 147 gsm and was constructed from fibers pulps that contained greater than about 80 wt % wood fibers at about a 4:1 weight ratio of hardwood fibers to softwood fibers. The cellulose-based paper substrate also contained about 11 wt % inorganic fillers (mixture of carbonates titanium dioxide and clays) that were added to the wet raw base fiber structure. All layers were applied sequentially to both sides of the cellulose-based paper substrate.

Regarding the application of the various layers, notably, Sample E was ultimately not fully prepared because the fumed silica could not be dispersed in water due to the lack of surface treatment as described herein. With respect to the other samples, the electrically charged treatment layer (T3) was applied first (except for comparative Sample H) to both sides of the cellulose-based paper substrate at a dry basis weight of about 2 gsm. The coating was dried to leave the electrically charged treatment layer. Next on both sides, an ink-absorbing layer was applied (except for in comparative Samples C and F), and then dried. Next, an ink-receiving layer was applied to both sides (except for in comparative Sample D), and then dried. The various layers were applied using a Mayer rod (and then dried between applications). In this example, the various print media samples were not calendered (except for comparative Sample C, which was calendered to achieve a relatively similar minimum level gloss for both unimaged and images portions), which is one benefit of the print media construction of the present disclosure, though in some examples, calendaring can be used.

The various print media were prepared in accordance with Table 4, with g/m$^2$ or gsm provided based on dry basis weight for all layers. Notably, Sample E was not completed because ink-absorbing layer composition A2 did not disperse adequately in water in a manner suitable to form a coating. The print medium samples otherwise prepared are shown in Table 4, as follows:

TABLE 4

| Print Medium Sample ID | Electrically Charged Treatment Layer | Ink-Absorbing Layer | Ink-Receiving Layer |
|---|---|---|---|
| A | T3 (2 gsm) | A1 (16.5 gsm) | R1 (0.5 gsm) |
| B | T3 (2 gsm) | A1 (18.5 gsm) | R2 (0.5 gsm) |
| C | T3 (2 gsm) | — | R3 (7 gsm) |
| D | T3 (2 gsm) | A1 (15 gsm) | — |
| E | T3 (2 gsm) | A2 (could not apply) | — |
| F | T3 (2 gsm) | — | R3 (10 gsm)<br>R2 (0.5 gsm) |
| G | T3 (2 gsm) | A1 (15 gsm) | R3 (1 gsm) |
| H | — | A1 (15 gsm) | R1 (0.5 gsm) |

Example 5—Print Performance of Inks Printed on Print Medium Samples A-H

Tables 5A-7B illustrate testing conducted on seven (7) of the eight print media samples set forth in Table 4 above. Sample E was not evaluated, as it was not successfully prepared. For the print performance evaluation, identical image sequences were printed on the various print medium samples for a specific test. After printing, and in some cases, subjecting the images to durability challenges, the image quality of the prints was evaluated with scores outlined in accordance with the protocols found in this example after Table 7B below. Some values were measurable with instrumentation, like Gamut, L* min, Black Image Gloss, and un-imaged Gloss. Others were not measurable solely with instrumentation, but rather were evaluated after conducting a prescribed testing protocol where a performance score was given ranging from 1 to 5 (where 1 represents the worst performance, 3 represents minimally acceptable target performance, and 5 represents the best performance). All testing was conducted at 23° C. and at 50% R.H. Diagnostic plots were generated for the different tests, including printed rectangles, printed strips, etc., suitable for the various testing protocols, which were printed using the HP Glossy Brochure Paper media selection. HP PageWide Pro PW777 Multifunction Printer and HP OfficeJet Pro X579 Printer were printed using "presentation" mode. HP DeskJet 2130 Printer used "normal" mode. The ink density and print speed were defined by the printer driver based on the print mode and media selection. Multiple types of inks and multiple types of printers were used for this evaluation. For example, in Tables 5A and 5B, the ink used for the data collected was a pigmented ink printed from an HP PageWide Pro PW777 Multifunction Printer (with Ink Supply HP 990A). In Tables 6A and 6B, an HP OfficeJet Pro X579 Printer was used with a pigmented ink (with Ink Supplies HP 970 and HP 971). In Tables 7A and 7B, an HP DeskJet 2130 Printer was used with a dye-based ink (with Ink Supply HP 63). Not every test was conducted using all three printers and all three inks, but the data is provided below, as follows:

TABLE 5A

| Print Medium Test Conducted | Sample A | Sample B | Sample C | Sample D |
|---|---|---|---|---|
| Duplex Scratch-Visual | 5 | 4 | 5 | 1 |
| Black Finger Smudge-Visual | 5 | 5 | 5 | 3 |
| Burnish-Visual | 5 | 5 | 1 | 5 |
| Gamut | 492 k | 496 k | 429 k | 490 k |
| L* min | 3.09 | 2.85 | 7.52 | 2.7 |
| Black Image Gloss (60°) | 50.9 | 57.7 | 26.9 | 51.5 |
| Un-imaged Gloss (60°) | 21.8 | 26.8 | 16.3 | 15.8 |

TABLE 5B

| Print Medium Test Conducted | Sample E | Sample F | Sample G | Sample H |
|---|---|---|---|---|
| Duplex Scratch-Visual | A2 did not | 5 | 4 | 1 |
| Black Finger Smudge-Visual | Disperse | 5 | 5 | 1 |
| Burnish Visual | in Water | 1 | 2 | 5 |
| Gamut | (Unable to | 447 k | 476 k | 484 k |
| L* min | Make) | 6.8 | 3.28 | 2.33 |
| Black Image Gloss (60°) | | 20.8 | 54.7 | 30.8 |
| Un-imaged Gloss (60°) | | 12.9 | 27.3 | 25.1 |

TABLE 6A

| Print Medium Test Conducted | Sample A | Sample B | Sample C | Sample D |
|---|---|---|---|---|
| Burnish-Visual | 5 | 5 | 1 | 3 |
| Black Image Gloss (60°) | 42.7 | 51.1 | 11 | 50.8 |
| *Un-imaged Gloss (60°) | 21.8 | 26.8 | 16.3 | 15.8 |

TABLE 6B

| Print Medium Test Conducted | Sample E | Sample F | Sample G | Sample H |
|---|---|---|---|---|
| Burnish-Visual | A2 did not | 1 | 3 | 5 |
| Black Image Gloss (60°) | Disperse | 14 | 52.9 | 49.4 |
| *Un-imaged Gloss (60°) | in Water (Unable to Make) | 12.9 | 27.3 | 25.1 |

*Un-imaged Gloss (60°) is the same measurement as taken in Tables 5A and 5B but is included Tables 6A and 6B to provide a comparison of the Black Image Gloss provided in these Tables as well.

TABLE 7A

| Print Medium Test Conducted | Sample A | Sample B | Sample C | Sample D |
|---|---|---|---|---|
| Black smudge-Visual | 5 | 4 | 1 | 4 |
| Image Gloss Surface Uniformity-Visual | 5 | 5 | 2 | 5 |
| Burnish-Visual | 5 | 4 | 1 | 3 |
| Coalescence-Visual | 5 | 5 | 3 | 5 |

TABLE 7B

| Print Medium Test Conducted | Sample E | Sample F | Sample G | Sample H |
|---|---|---|---|---|
| Black Finger Smudge-Visual | A2 did not | 1 | 5 | 4 |
| Image Gloss Surface Uniformity-Visual | Disperse in Water | 2 | 1 | 5 |
| Burnish-Visual | (Unable to | 1 | 1 | 3 |
| Coalescence-Visual | Make) | 1 | 5 | 5 |

As can be seen in Tables 5A-7B, across three different types of inks from three different printers, print media Samples A and B outperformed all of the remaining examples, namely comparative print media Samples C-H. Though some comparative print media samples performed well in some categories, they all performed mediocre in some categories, and all of the comparative print media performed poorly in at least one category. Conversely, across all three inks, both Samples A and B performed very well or above-average in all categories tested.

The testing protocols used to generate the data shown in Tables 5A-7B were as follows:

Duplex Scratch was evaluated with a printed diagnostic plot printed using an HP Brochure Glossy, presentation mode, setting. The diagnostic plot on the first side is one plot that was exposed to scratching. After the first side is imaged, the sheet was reversed by the printer which allowed the first side imaged to rub against the plastic ribs of the printer during the imaging of the second side. After printing, the first side that was imaged was examined for scratching in the imaged areas. With extreme scratching (score of 1), the ink plot would be entirely removed in the region where the image rubbed against the plastic rib, creating white lines across the plot. A score of 5 would be achieved if there was no evidence of scratching.

Black Finger Smudge was evaluated with a printed diagnostic plot printed using an HP Brochure Glossy, presentation mode, setting. Upon printing, this evaluation targeted three (3) time periods for the finger smudge testing, namely at 0 minutes, 1 minute, and 2 minutes. At these three times, various sets of plots (or smudge blocks) were smudged using a clean, dry finger using firm pressure. Evaluation of the smudge blocks was done visually by comparing the printed smudge blocks with the areas immediately adjacent to the printed smudge blocks to inspect for ink removal from the printed area and ink transfer to the area adjacent thereto. A score of 1 would indicate significant smudging, even at 2 minutes. A score of 5 would indicate no smudging at times greater than 1 minute. At 0 minutes (almost instantaneous drying), a very slight smudge (barely visible) may or may not be present.

Burnish was evaluated with a printed diagnostic plot printed using HP PageWide Pro PW777 Multifunction Printer and HP DeskJet 2130 Printer. The plots were prepared as red area fill plots. The printer setting used was HP Brochure Glossy, presentation mode (HP PageWide Pro PW777 Multifunction Printer) or normal (HP DeskJet 2130 Printer). The burnishing device was an inclined ramp with a weighted sled to test the rubbing of a printed image face to a printed image face of two separate plots on printed on two media sheets. Burnish is defined herein to related to the damage to an imaged media surface caused by contact with either other media sheets or from handling. For this test, images were allowed to dry for 24 hours before testing for burnish. It is noted that typically damage tends to modify gloss for regions that become rubbed compared to non-contacted areas of printed media. Burnish can happen from shuffling printed media sheets (light contact), for example. To simulate burnish that often occurs as users handle printed media, a lab test includes taking a sample print medium with a solid-fill red plot, cutting a 2.5 inch strip along a long axis of the sheet, removing a 2.5 inch square from one end of the strip, and taping the square to a bottom surface of the weighted sled. The remaining portion of the printed strip is clipped to the ramp. The sled is placed at the top of the test strip so that the printed red square and the printed red strip are in contact face to face (red printed face to red printed face). One side of the ramp is then raised until the incline is sufficient to allow the sled to slide the slope. The printed red strip is then visually examined for damage. A score of 1 would indicate significant damage and a score of 5 would indicate no damage.

Gamut was evaluated with a printed diagnostic plot printed using an HP Brochure Glossy, presentation mode, setting, and multiple printed plots of various colors (gamut rectangles) were printed on the various print media sheets. The printer setting used was HP Brochure Glossy, presentation mode. Specifically, gamut volume was calculated using L*a*b* values of 8 colors (cyan, magenta, yellow, black, blue, red, green, white) measured with an X-RITE® 939 Spectro-densitometer (X-Rite Corporation), using D65 illuminant and 2° observer angle. L*min value testing is carried out on a black printed area and is measured with an X-RITE® 939 Spectro-densitometer, using D65 illuminant and 2° observer angle. Gamut Measurement (Gamut) represents the amount of color space covered by the ink on the media. For the gamut evaluation, the printed diagnostic plots image to dry 24 hrs, and the L*a*b* color space values for the specified 8 colors were measured, and the gamut calculations were made using the measured L*a*b* values. The values in Tables 5A and 5B were measured and calculated values, Gamut is calculated from the L*a*b* values.

L* min, 100% black, was determined using the printed black diagnostic plots (black rectangles) used for the gamut evaluation. The printer setting used was HP Brochure Glossy, presentation mode. The L* values were measured using an X-RITE®939 Spectro-densitometer (X-Rite Corporation), using D65 illuminant and 2° observer angle, and this black L* data was collected and is separately reported in Tables 5A and 5B at the time of collecting gamut data.

Black image gloss at 60° was determined using the printed black diagnostic plots (black rectangles) used for the gamut evaluation. The printer setting used was HP Brochure Glossy, presentation mode. The Black image gloss data was collected from the black rectangles printed as part of the gamut plots. A BYK Gardner micro-TRI-gloss meter was used to collect the gloss data at 60°. The printed black rectangles were allowed to dry for 24 hours prior to collecting gloss data.

Coalescence was evaluated using the gamut color plots (or rectangular blocks) outlined above that were used to determine color gamut as well as used for a few other evaluations. For this evaluation, a visual inspection of the seven printed colors (6 colors and black) for print uniformity for the various colors as singly printed. A score of 1 would indicate that the single color is noticeably and significantly non-uniform. For example, instead of seeing a uniform green region, a score of 1 will have small sub-areas that are of a different color. A score of 5 would indicate color uniformity across the individual plot with all of the various color samples.

Image Gloss Surface Uniformity was evaluated using the gamut color plots (or rectangular blocks) outlined above that were used to determine color gamut as well as used for a few other evaluations. For this evaluation, a visual inspection of the seven printed colors (6 colors and black) for surface gloss uniformity of the various individually printed colors. A score of 1 would indicate that the gloss within a single-color printed region appears to be blotchy. The non-uniformity of the gloss is on an approximately 1-2 square mm scale. A score of 5 would indicate surface gloss uniformity across the individual plots for all of the various color samples.

It is to be understood that this disclosure is not limited to particular process steps and materials disclosed herein because such process steps and materials may vary somewhat. It is also to be understood that the terminology used herein is used for the purpose of describing particular examples. The terms are not intended to be limiting because the scope of the present disclosure is intended to be limited only by the appended claims and equivalents thereof.

What is claimed is:

1. A print medium, comprising:

a cellulose-based paper substrate including a first surface and a second surface opposite the first surface, the first surface treated with an electrically charged treatment layer, wherein the electrically charged treatment layer is electrically charged with calcium chloride, calcium acetate, calcium nitrate, calcium formate, magnesium chloride, barium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, or a combination thereof;

an ink-absorbing layer on the electrically charged treatment layer, the ink-absorbing layer including a polymeric binder and surface-activated fumed silica particles, wherein the surface-activated fumed silica particles include fumed silica particles that are surface-activated with charged multivalent aluminum salt and organosilane reagent; and an ink-receiving layer on the ink-absorbing layer, the ink-receiving layer including amorphous silica particles, alumina particles, or a combination thereof.

2. The print medium of claim 1, wherein the electrically charged treatment layer is electrically charged with calcium chloride, calcium acetate, or a combination thereof.

3. The print medium of claim 1, wherein the charged multivalent aluminum salt of the ink-absorbing layer includes aluminum chlorohydrate.

4. The print medium of claim 1, wherein the organosilane reagent of the ink-absorbing layer includes amine-containing methoxysilane.

5. The print medium of claim 1, wherein the ink-receiving layer includes the amorphous silica particles and the alumina particles, wherein the alumina particles include boehmite alumina particles, amorphous alumina particles, or the amorphous silica particles and the alumina particles are present in the form of amorphous silica-alumina particles.

6. The print medium of claim 1, wherein the electrically charged treatment layer has a dry basis weight from 0.1 gsm to 3 gsm at the first surface, the ink-absorbing layer has a dry basis weight from 5 gsm to 30 gsm, and the ink-receiving layer has a dry basis weight from 0.1 gsm to 5 gsm.

7. The print medium of claim 1, wherein the second surface is treated with a second electrically charged treatment layer, a second ink-absorbing layer is on the second electrically charged treatment layer, and a second ink-receiving layer is on the second ink-absorbing layer.

8. The print medium of claim 1, wherein the electrically charged treatment layer is compositionally the same as the second electrically charged treatment layer, the ink-absorbing layer is compositionally the same as the second ink-absorbing layer, and the ink-receiving layer is compositionally the same as the second ink-receiving layer.

9. The print medium of claim 1, wherein the polymeric binder in the ink-absorbing layer is crosslinked.

10. The print medium of claim 1, wherein the surface-activated fumed silica particles are present in the ink-absorbing layer at from 40 wt % to about 95 wt % by dry weight.

11. A method of making a print medium, comprising:

treating a first surface of cellulose-based paper substrate with a treatment solution including an electrolyte compound to form an electrically charged treatment layer, wherein the electrically charged treatment layer is electrically charged with calcium chloride, calcium acetate, calcium nitrate, calcium formate, magnesium chloride, barium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, or a combination thereof;

coating the electrically charged treatment layer with ink-absorbing coating composition including polymeric binder and surface-activated fumed silica particles to form an ink-absorbing layer, the surface-activated fumed silica particles comprising fumed silica particles that are surface-activated with charged multivalent aluminum salt and organosilane reagent; and coating the ink-absorbing layer with an ink-receiving coating composition that includes colloidal silica particles, alumina particles, or both to form an ink-receiving layer including amorphous silica particles, alumina particles, or a combination thereof.

12. The method of claim 11, further comprising sequentially drying:

the treatment solution after application to the first surface to form the electrically charged treatment layer, the ink-absorbing coating composition after application to form the ink-absorbing layer, and the ink-receiving coating composition after application to form the ink-receiving layer.

13. The method of claim 11, wherein treating the first surface results in the electrically charged treatment layer having a dry basis weight from 0.1 gsm to 3 gsm at the first surface, coating the electrically charged treatment layer results in an ink-absorbing layer having a dry basis weight from 5 gsm to 30 gsm, and coating the ink-absorbing layer results in an ink-receiving layer having a dry basis weight from 0.1 gsm to 5 gsm.

14. A method of printing, comprising jetting an ink composition onto a print medium, wherein the print medium includes:

a cellulose-based paper substrate including a first surface and a second surface opposite the first surface, the first surface treated with an electrically charged treatment layer, wherein the electrically charged treatment layer is electrically charged with calcium chloride, calcium acetate, calcium nitrate, calcium formate, magnesium chloride, barium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, or a combination thereof;

an ink-absorbing layer on the electrically charged treatment layer, the ink-absorbing layer including a polymeric binder and surface-activated fumed silica particles, wherein the surface-activated fumed silica particles include fumed silica particles that are surface-activated with charged multivalent aluminum salt and organosilane reagent; and an ink-receiving layer on the ink-absorbing layer, the ink-receiving layer including amorphous silica particles, alumina particles, or a combination thereof.

15. The method of claim 14, wherein the ink-receiving layer includes the amorphous silica particles and the alumina particles, wherein the alumina particles include boehmite alumina, amorphous alumina, or the amorphous silica particles and the alumina particles are present in the form of amorphous silica-alumina particles.

16. The print medium of claim 1, wherein the electrically charged treatment layer is electrically charged with calcium nitrate, calcium formate, magnesium chloride, barium chloride, manganese sulfate, magnesium nitrate, magnesium acetate, magnesium formate, tin chloride, tin nitrate, manganese chloride, manganese sulfate, manganese nitrate, manganese formate, or a combination thereof.

17. The method of claim 11, wherein the electrically charged treatment layer is electrically charged with calcium chloride, calcium acetate, or a combination thereof.

18. The method of claim 11, wherein the electrically charged treatment layer is electrically charged with calcium nitrate, calcium formate, magnesium chloride, barium chloride, manganese sulfate, magnesium nitrate, magnesium acetate, magnesium formate, tin chloride, tin nitrate, manganese chloride, manganese sulfate, manganese nitrate, or manganese formate.

19. The method of claim 14, wherein the electrically charged treatment layer is electrically charged with calcium chloride, calcium acetate, or a combination thereof.

20. The method of claim 14, wherein the electrically charged treatment layer is electrically charged with calcium nitrate, calcium formate, magnesium chloride, barium chloride, manganese sulfate, magnesium nitrate, magnesium acetate, magnesium formate, tin chloride, tin nitrate, manganese chloride, manganese sulfate, manganese nitrate, or manganese formate.

* * * * *